US008357438B2

(12) United States Patent
Asao et al.

(10) Patent No.: US 8,357,438 B2
(45) Date of Patent: Jan. 22, 2013

(54) RECORDING MEDIUM

(75) Inventors: Masaya Asao, Yokohama (JP); Hiroshi Asakawa, Ebina (JP); Yuji Kondo, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 308 days.

(21) Appl. No.: 12/776,271

(22) Filed: May 7, 2010

(65) Prior Publication Data

US 2010/0291325 A1 Nov. 18, 2010

(30) Foreign Application Priority Data

May 12, 2009 (JP) ..... 2009-115540

(51) Int. Cl.
*B41M 5/00* (2006.01)

(52) U.S. Cl. ..... 428/32.24; 428/32.25; 428/32.34; 428/32.36

(58) Field of Classification Search ..... 428/32.24, 428/32.25, 32.34, 32.36
See application file for complete search history.

(56) References Cited

U.S. PATENT DOCUMENTS

| | | | | |
|---|---|---|---|---|
| 5,041,328 | A | 8/1991 | Akiya | |
| 6,344,262 | B1 | 2/2002 | Suzuki | |
| 2001/0009712 | A1* | 7/2001 | Totani et al. | 428/195 |
| 2006/0120932 | A1* | 6/2006 | Takemura et al. | 423/111 |

FOREIGN PATENT DOCUMENTS

| | | | |
|---|---|---|---|
| JP | 61-057380 | A | 3/1986 |
| JP | 63-166586 | A | 7/1988 |
| JP | 2000-177235 | A | 6/2000 |

* cited by examiner

*Primary Examiner* — Betelhem Shewareged
(74) *Attorney, Agent, or Firm* — Canon U.S.A., Inc., IP Division

(57) ABSTRACT

A recording medium includes a substrate and at least two ink receiving layers formed on the substrate. In the recording medium, an uppermost ink receiving layer of the at least two ink receiving layers has a dry coated amount of 5 g/m$^2$ or more and 20 g/m$^2$ or less and contains hydrated alumina which a divalent metal compound adheres to. The ratio of an element content of the divalent metal to an element content of aluminum (element content of divalent metal/element content of aluminum) in the uppermost ink receiving layer is 0.001 or more and 0.03 or less.

9 Claims, 2 Drawing Sheets

RECORDING MEDIUM

BACKGROUND OF THE INVENTION

1. Field of the Invention

The present invention relates to a recording medium.

2. Description of the Related Art

To improve the fastness of recorded images, metal ions or metal salts have been provided in an ink receiving layer of a recording medium used for inkjet recording or the like. Japanese Patent Laid-Open No. 2000-177235 discloses a recording medium obtained by simply adding a water-soluble metal salt or a slightly soluble metal compound to an ink receiving layer containing hydrated alumina to improve the fastness of recorded images, ink absorbency, and ink fixing property and to achieve high color density and the like. Japanese Patent Laid-Open No. 61-57380 discloses a recording medium that contains a porous inorganic pigment, a cationic resin, and a magnesium compound whose solubility in water is 1% or less at room temperature to improve water resistance and light resistance and to achieve high color density. Japanese Patent Laid-Open No. 63-166586 discloses that silica is subjected to surface treatment with a compound or a salt of metal ions having at least univalence to improve the fastness of recorded images. This means that silica is subjected to surface treatment with a metallic soap, a metal hydroxide, a metal salt, or a metal oxide. It is disclosed that silica is subjected to surface treatment by adding a metal salt to silica at 90° C., which is a heating condition when silica is synthesized, and then by aging it for 20 minutes.

However, the inventors of the present invention found that the above-described related technologies contain the following problems. For the recording medium disclosed in Japanese Patent Laid-Open No. 2000-177235, a water-soluble metal salt is merely impregnated or dispersed thereinto. After printing, such a water-soluble metal salt does not remain on the surface of the ink receiving layer and easily enters the ink receiving layer together with a solution. As a result, the image fastness is slightly improved, but a coloring material easily enters the ink receiving layer, which causes the image to have insufficient optical density. For the recording medium disclosed in Japanese Patent Laid-Open No. 61-57380, the image fastness is improved, but the effect is not sufficiently high. It is believed that this is because a dye is not always present near magnesium compound particles after printing and thus the effect to be produced by addition of a magnesium compound is not sufficiently achieved. In the method for subjecting silica to surface treatment disclosed in Japanese Patent Laid-Open No. 63-166586, since a metal is present in a state in which the metal is easily soluble in water, a metal contained in a coating solution is eluted, which easily increases the viscosity of the coating solution. Furthermore, it is difficult to improve the color development property of a recording medium manufactured. It is believed that this is because the coating solution easily aggregates due to the eluted metal ions, which decreases the transparency of the ink receiving layer.

SUMMARY OF THE INVENTION

The present invention provides a recording medium having satisfactory fastness and optical density of printed images.

The present invention provides a recording medium including a substrate; and at least two ink receiving layers formed on the substrate, wherein an uppermost ink receiving layer of the at least two ink receiving layers has a dry coated amount of 5 g/m$^2$ or more and 20 g/m$^2$ or less and contains hydrated alumina which a divalent metal compound adheres to, and the ratio of an element content of the divalent metal to an element content of aluminum (element content of divalent metal/element content of aluminum) in the uppermost ink receiving layer is 0.001 or more and 0.03 or less.

According to the present invention, there can be provided a recording medium having satisfactory fastness and optical density of printed images.

Further features of the present invention will become apparent from the following description of exemplary embodiments with reference to the attached drawings.

BRIEF DESCRIPTION OF THE DRAWINGS

FIG. 3 shows the measurement result of a mass spectrum (m/z=16) obtained for ammonia, the mass spectrum being measured by temperature-programmed desorption (TPD) for ammonia. The symbol "a" denotes a curve of hydrated alumina and the symbol "b" denotes a curve of hydrated alumina which magnesium acetate tetrahydrate adheres to.

FIG. 4 shows the measurement result of a mass spectrum (m/z=18) obtained for water, the mass spectrum being measured by temperature-programmed desorption (TPD) for ammonia. The symbol "a" denotes a curve of hydrated alumina and the symbol "b" denotes a curve of hydrated alumina which magnesium acetate tetrahydrate adheres to.

DESCRIPTION OF THE EMBODIMENTS

Figure 1:
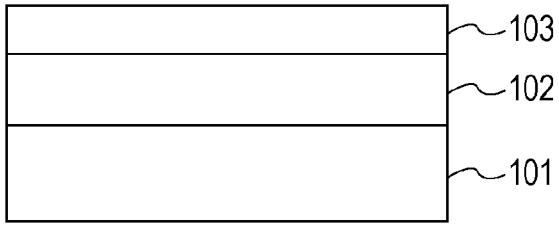
FIG. 1 shows an example of a recording medium of the present invention.

The present invention will now be further described in detail with preferred embodiments. As shown in FIG. 1, a recording medium of the present invention includes a substrate 101 and ink receiving layers 102 and 103 formed on the substrate.

Among the at least two ink receiving layers, the ink receiving layer 103 that is an uppermost surface layer has a dry coated amount of 5 g/m$^2$ or more and 20 g/m$^2$ or less. The uppermost ink receiving layer contains hydrated alumina which a divalent metal compound adheres to. The ratio of an element content of the divalent metal to an element content of aluminum (element content of divalent metal/element content of aluminum) in the uppermost ink receiving layer is 0.001 or more and 0.03 or less. The uppermost ink receiving layer improves the fastness and optical density of printed images.

A mechanism with which the fastness of images is improved is described. The inventors of the present invention assumed the gas degradation mechanism of a coloring material attached to a hydrated alumina as follows. The assumed mechanism is described with reference to FIGS. 2A and 2B.

Figure 2A:
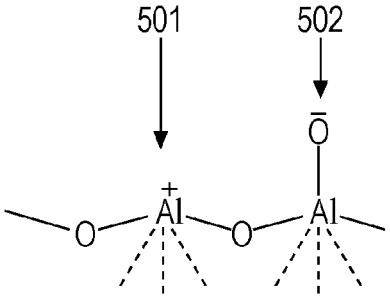
FIG. 2A shows the state of hydrated alumina whose surface is not adsorbed by water molecules and FIG. 2B shows the state of hydrated alumina whose surface is adsorbed by water molecules.
Figure 2B:
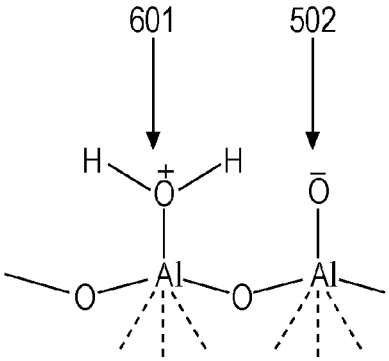

FIG. 2A shows the state of hydrated alumina whose surface is not adsorbed by water molecules. In FIG. 2A, there are a Lewis acid site 501 and a base site 502 in hydrated alumina. However, a water molecule adsorbs to the Lewis acid site 501 shown in FIG. 2A in the presence of moisture in the air, ink for dyeing, or the like. Consequently, the Lewis acid site 501 is changed into a Brönsted acid site 601 as shown in FIG. 2B. When the water molecule that adsorbs to the Brönsted acid site 601 is subjected to gas such as ozone, a radical is generated due to the interaction between ozone and the water molecule. The radical oxidizes the coloring material attached to the surface of hydrated alumina, and thus the coloring material is decomposed. As a result, the coloring material is degraded.

The inventors of the present invention considered that it is important to suppress the radical generation reaction due to the interaction between ozone gas and water molecules that have adsorbed to Lewis acid sites of the surface of a hydrated alumina. Consequently, they found that gas resistance is improved by using hydrated alumina which a divalent metal compound adheres to. It is believed that this is because hydrated alumina loses an acid function by causing the divalent metal compound to adhere to the surface of the hydrated alumina. The surface of hydrated alumina of the present invention includes inner wall surfaces of pores of porous hydrated alumina in addition to the surface of hydrated alumina.

Figure 3:
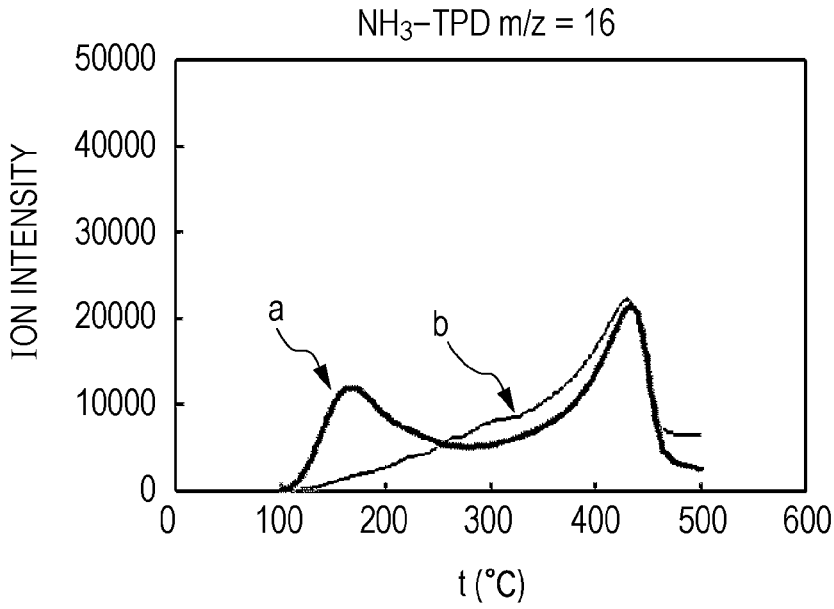
Figure 4:
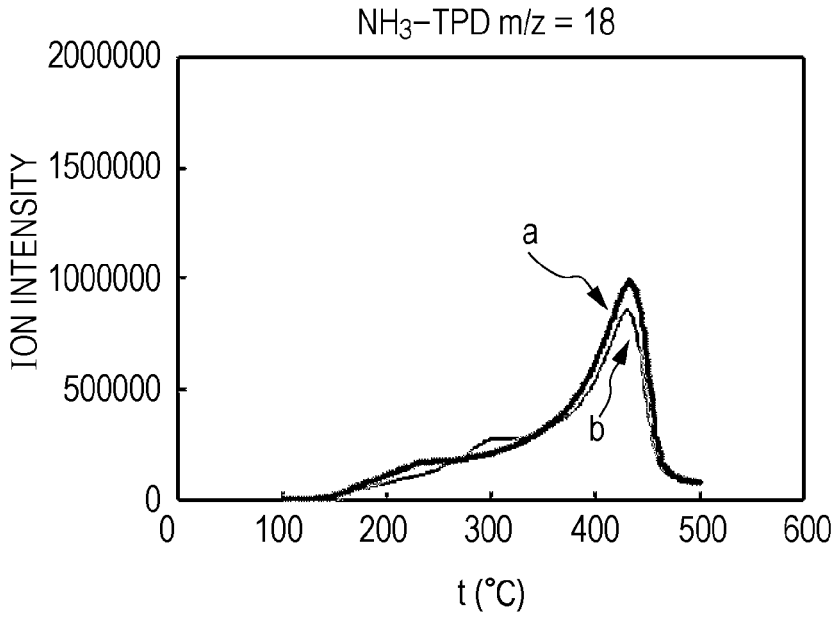

The acid function of the surface of the hydrated alumina can be determined by a gas adsorption method such as temperature-programmed desorption (TPD). For example, FIGS. 3 and 4 show the measurement results of temperature-programmed desorption (TPD) for ammonia. FIG. 3 shows measurement data of a mass spectrum (m/z=16) obtained for ammonia. The symbol "a" in FIG. 3 denotes a curve of hydrated alumina and the symbol "b" denotes a curve of hydrated alumina which magnesium acetate tetrahydrate adheres to. When the temperature t is about slightly lower than 200° C., there is a difference between a and b. It is believed that the peak at a temperature t of about slightly lower than 200° C. indicates ammonia that has undergone physical adsorption. Since ammonia that has undergone physical adsorption is not confirmed in b of the present invention, it can be assumed that the number of acid sites (portions having an acid function) that are chemical adsorption sites causing physical adsorption of ammonia molecules is decreased. Thus, it is believed that the acid sites of hydrated alumina are lost due to magnesium acetate tetrahydrate adhering to the surface of the hydrated alumina, which degrades the acid function of the surface of the hydrated alumina. At a temperature t of about slightly higher than 400° C., peaks are observed in a and b. However, because the peaks correspond to the peak shown in FIG. 4 and that indicates measurement data of a mass spectrum (m/z=18) obtained for water, it is believed that the peak appears due to dehydration caused by a change in the crystal structure of the hydrated alumina (hydrated alumina→γ-alumina).

In the present invention, the divalent metal can be at least one metal selected from Mg, Ca, Sr, and Ba. With a metal compound containing such a metal, gas resistance can be improved. Examples of the divalent metal compound include salts of an alkaline-earth metal and an organic acid ion such as an acetic acid ion or an oxalic acid ion; salts of an alkaline-earth metal and an inorganic acid ion such as a sulfuric acid ion, a nitric acid ion, a carbonic acid ion, a halogen ion, or a hydroxyl ion; and oxides of the above-described metals.

Furthermore, when a divalent metal adheres to hydrated alumina, the divalent metal suppresses the generation of active radicals, which improves the light resistance.

In a recording medium of the present invention, the ratio of an element content of the divalent metal to an element content of aluminum (element content of divalent metal/element content of aluminum) in the uppermost ink receiving layer is 0.001 or more and 0.03 or less and preferably 0.005 or more and 0.02 or less. If the ratio is less than 0.001, an effect on fastness is not sufficiently achieved. If the ratio is more than 0.03, the viscosity of a coating solution increases and thus the coating solution easily becomes unstable, and the optical density of printed images tends to decrease.

When hydrated alumina which a divalent metal compound adheres to is used as a typical ink receiving material, the transparency of the ink receiving layer is easily degraded because a coating solution easily causes aggregation. Furthermore, since the pore size of the ink receiving layer increases, ink easily sinks to a deep position in the ink receiving layer during image formation, which decreases the optical density of the image.

In the present invention, however, an ink receiving layer containing hydrated alumina which a divalent metal compound adheres to, that is, an uppermost ink receiving layer has a dry coated amount of 5 $g/m^2$ or more and 20 $g/m^2$ or less. This can prevent ink from sinking and increase the optical density of an image. In other words, a recording medium having satisfactory fastness and optical density of an image can be obtained. If the dry coated amount of the uppermost ink receiving layer is less than 5 $g/m^2$, an effect on fastness is not sufficiently achieved. If the dry coated amount is more than 20 $g/m^2$, a coloring material sinks to a deep position in the ink receiving layer, which decreases the optical density of an image. The dry coated amount of the uppermost ink receiving layer is preferably 8 $g/m^2$ or more.

The ink receiving layer can include an inorganic pigment and a binder. In particular, the ink receiving layer other than the uppermost ink receiving layer can include an inorganic pigment and a binder. As a result, the sinking of a dye can be suppressed particularly at a boundary surface between the uppermost ink receiving layer and the ink receiving layer located directly under the uppermost ink receiving layer. Thus, an image having high optical density can be formed. An inorganic pigment typically used for an inkjet recording medium can be used as the inorganic pigment. Examples of the inorganic pigment include coating pigments such as hydrated alumina, aluminum oxide, synthetic silica, calcium carbonate, basic magnesium carbonate, barium sulfate, titanium dioxide, zinc oxide, zinc carbonate, satin white, aluminum silicate, magnesium silicate, calcium silicate, aluminum hydroxide, kaoline, talc, and hydrotalcite. The inorganic pigments are used alone or in combination. An inorganic pigment having a large specific surface area and high ink absorbency is more suitable. Examples of such an inorganic pigment include hydrated alumina and synthetic silica. A publicly known binder can be used. Examples of the binder include polyvinyl alcohol and its modified body; starch and its modified body; gelatin and its modified body; casein and its modified body; gum arabic; cellulose derivatives such as carboxymethylcellulose, hydroxyethylcellulose, and hydroxypropyl methylcellulose; conjugated diene copolymer latexes such as a styrene-butadiene rubber (SBR) latex, a nitrile-butadien rubber (NBR) latex, and a methylmethacrylate-butadiene copolymer; vinyl copolymer latexes such as a functional group-modified polymer latex and a ethylene-vinyl acetate copolymer; polyvinyl pyrrolidone; maleic anhydride and its copolymer; and acrylic ester copolymers. In the present invention, polyvinyl alcohol is suitable as the binder. Furthermore, polyvinyl alcohol can be combined with another publicly known binder. The amount of the binder added is preferably 3% or more and 50% or less by mass relative to the amount of inorganic pigment.

A method for causing a divalent metal compound to adhere to hydrated alumina will now be described. An example of the method includes a method in which aluminum hydroxide or hydrated alumina is subjected to hydrothermal synthesis in the presence of a divalent metal compound. In this method, the divalent metal compound can be taken into a crystal structure while the crystal of hydrated alumina is grown, which can prevent elution of the supported divalent metal compound. The temperature and pressure ranges in hydrothermal synthesis are each desirably within a region where a boehmite phase stably exists in a phase diagram of $Al_2O_3$—$H_2O$ system. Thus, the temperature in hydrothermal synthesis is preferably 150° C. or higher and the pressure is preferably 100 atm or lower. If the temperature is lower than 150° C., boehmite cannot be obtained. If a temperature of 350° C. or higher is maintained for a long time, the boehmite phase disadvantageously changes into an α-alumina phase. Thus, the temperature is preferably 150° C. or higher and 350° C. or lower. If the pressure is higher than 100 atm, coarse thick particles are undesirably obtained. The pressure is preferably 10 atm or higher because a hydrothermal system is not established in an open system.

Alternatively, the method for causing a divalent metal compound to adhere to hydrated alumina may be a method in which hydrated alumina is dried in the presence of a divalent metal compound. Specifically, a slurry obtained by dispersing hydrated alumina and a divalent metal compound is mixed using a stirrer. A pH adjusting agent such as an acid or an alkali, a dispersion stabilizer such as a nonionic surfactant or an anionic surfactant, or the like may be optionally added. Subsequently, the slurry containing the hydrated alumina and the divalent metal compound is dried. Examples of the drying method include a method using a furnace and a spray-drying method, and the spray-drying method is more suitable because the method can uniformly disperse the divalent metal compound on the surface of the hydrated alumina. The heating temperature in the spray-drying method, that is, the ambient temperature (gas phase temperature) can be a temperature that vaporizes a solvent contained in the slurry. If the ambient temperature is higher than 350° C., a boehmite phase changes into an α-alumina phase, which is disadvantageous for generation of the boehmite phase. Therefore, when water is used as a solvent, the ambient temperature can be 100° C. or higher and 300° C. or lower.

Alternatively, the method for causing a divalent metal compound to adhere to hydrated alumina may be a method in which a solution obtained by dissolving a divalent metal compound is added to a dispersoid obtained by dispersing hydrated alumina into a solvent, the resultant mixture is stirred, and an alkali such as ammonia water is added to the resultant mixture to perform neutralization. After hydrated alumina is produced by such a method, the divalent metal compound that is excessively present can be optionally removed by cleaning the hydrated alumina with a solvent such as water.

Hydrated alumina suitable in the present invention is represented by the following formula (1):

$$Al_2O_{3-n}(OH)_{2n}.mH_2O \quad (1)$$

where n is a value selected from 0, 1, 2, and 3 and m is a value from 0 to 10, preferably from 0 to 5. Herein, at least one of m and n is more than 0. Since $mH_2O$ often represents an aqueous phase that can be eliminated and does not contribute to the formation of a crystal lattice, m can be a value of an integer or a value other than an integer. When this type of material is heated, m may have a value of 0.

Hydrated alumina can be manufactured by a publicly known method. Typical examples of the method include hydrolysis of aluminum alkoxide or sodium aluminate (U.S. Pat. Nos. 4,242,271 and 4,202,870) and neutralization performed by adding an aqueous solution of aluminum sulfate or aluminum chloride to an aqueous solution of sodium aluminate (Japanese Patent Publication No. 57-447605).

The hydrated alumina suitable in the present invention can have a boehmite structure or an amorphous structure in the analysis through X-ray diffraction. In particular, hydrated aluminas disclosed in Japanese Patent Laid-Open Nos. 7-232473, 8-132731, 9-66664, and 9-76628 can be advantageously used.

The porous properties of hydrated alumina may be adjusted during the manufacturing process. For example, to use hydrated alumina as a material of an ink receiving layer, hydrated alumina preferably has a pore volume of 0.3 to 1.0 ml/g and more preferably 0.35 to 0.9 ml/g. The BET specific surface area obtained by a BET method is preferably 50 to 350 $m^2/g$ and more preferably 100 to 250 $m^2/g$. The BET method is one of methods for measuring a surface area of powder through gas phase adsorption. In the BET method, a total surface area per 1 g of sample, that is, a specific surface area is obtained from an adsorption isotherm. Nitrogen gas is often used as adsorption gas. Most commonly, there is employed a method in which an adsorption amount is measured from a change in pressure or volume of gas to be adsorbed. The most famous equation that represents an isotherm of multimolecular adsorption is an equation of Brunauer, Emmett, and Teller, also called a BET equation, which is widely used for determining a specific surface area. An adsorption amount is determined on the basis of the BET equation, and the adsorption amount is multiplied by an area occupied by one adsorption molecule on a surface. Thus, a specific surface area is obtained. The hydrated alumina preferably has a number-average particle size of 1 nm or more and 10 nm or less, and more preferably 50 nm or less. Herein, the number-average particle size can be measured with a transmission electron microscope (TEM).

A method for manufacturing a recording medium of the present invention will now be described. The recording medium of the present invention can be formed by coating a substrate having an ink receiving layer formed thereon with a coating solution containing at least a binder and the above-described hydrated alumina which a divalent metal compound adheres to and then by drying the coating solution. Water is advantageously used as a dispersion medium of the coating solution.

Normally, when hydrated alumina is dispersed, an acid can be added to a dispersion solution of the present invention because hydrated alumina is easily deflocculated and a uniform dispersoid is thereby formed. Examples of the commonly known acid that functions as a deflocculating agent include organic acids such as acetic acid, formic acid, and oxalic acid; and inorganic acids such as nitric acid, hydrochloric acid, and sulfuric acid.

Other additives can be optionally added to the coating solution of the present invention. Examples of the other additives include a cross-linking agent, a thickener, a pH adjusting agent, a lubricant, a fluidity modifier, a surfactant, an antifoaming agent, a release agent, a fluorescent whitening agent, an ultraviolet absorber, and an antioxidant.

At least one type of boric acid compound can be added as a cross-linking agent to the coating solution of the present invention. This is significantly effective in the formation of an ink receiving layer. Examples of the boric acid compound include orthoboric acid ($H_3BO_3$), metaboric acid, hypoboric acid, and a borate. A water-soluble salt of the above-described boric acid can be used as the borate. Examples of the borate include alkali metal salts such as sodium salts (e.g., $Na_2B_4O_7.10H_2O$ and $NaBO_2.4H_2O$) and potassium salts (e.g., $K_2B_4O_7.5H_2O$ and $KBO_2$); and ammonium salts (e.g., $NH_4B_4O_9.3H_2O$ and $NH_4BO_2$). In view of storage stability of the coating solution and suppression of cracking, orthoboric acid can be suitably used. The amount of the boric acid compound (orthoboric acid) added is preferably 1.0% or more and 15.0% by mass relative to the amount of the binder. However, even if the amount is within the range, cracking may be caused depending on the manufacturing conditions or the like. Therefore, the amount needs to be suitably adjusted. If the amount is more than 15.0% by mass, the storage stability of the coating solution may be degraded. That is, since the coating solution is used over a long time during the manufacturing of a recording medium, a large amount of boric acid compound added may increase the viscosity of the coating solution and produce a gel compound. Thus, replacement of the coating solution, cleaning of a coater head, and the like may be frequently required, which considerably reduce the productivity.

A substrate 101 will now be described. Paper such as a film, cast-coated paper, baryta paper, and resin-coated paper (paper coated on both faces with a resin such as polyolefin) can be used as the substrate 101. For example, a transparent thermoplastic resin film can be used as the film. Examples of the transparent thermoplastic resin film include polyethylene, polypropylene, polyester, polylactic acid, polystyrene, polyacetate, polyvinyl chloride, cellulose acetate, polyethylene terephthalate, polymethyl methacrylate, and polycarbonate.

In addition, water-leaf paper, which is paper subjected to appropriate sizing, coated paper, a sheet-like material (e.g., synthetic paper) composed of a film made to be opaque through filling of an inorganic substance or formation of minute bubbles can be used as the substrate 101. A sheet composed of glass or metal may also be used. Furthermore, to improve the adhesive strength between the substrate and an ink receiving layer, the surface of the substrate may be subjected to corona discharge treatment or undercoating treatment.

Ink receiving layers are formed by coating such a substrate with the above-described coating solution simultaneously or one layer after another.

Examples of an apparatus used for coating of at least two ink receiving layers include a slot die coater, a slide die coater, a curtain coater, a knife coater, and a bar coater. When the ink receiving layers are formed simultaneously, a simultaneous multilayer coating apparatus such as a specialized multilayer slot die coater, a multilayer slide die coater, or a multilayer curtain coater can be suitably used. The ink receiving layers are formed on at least one side of the substrate, but may be formed on both sides of the substrate in order to prevent curls and achieve inkjet recording onto both sides.

In consideration of ink absorbency, the ink receiving layers other than the uppermost ink receiving layer preferably have a dry coated amount of 30 g/m$^2$ or more and 60 g/m$^2$ or less. If the dry coated amount is less than 30 g/m$^2$, ink absorbency is sometimes not sufficiently achieved particularly in the case where the recording medium is used for a printer that uses a black ink set and a plurality of light color ink sets in addition to three-color ink sets of cyan, magenta, and yellow. That is, ink overflows and bleeding may be caused. If the dry coated amount is more than 60 g/m$^2$, cracking sometimes cannot be suppressed. When the dry coated amount is 30 g/m$^2$ or more, there can be provided an ink receiving layer having satisfactory ink absorbency even in a high temperature and humidity environment. When the dry coated amount is 60 g/m$^2$ or less, the coating unevenness of the ink receiving layer is further suppressed, which can provide an ink receiving layer having a uniform thickness.

In the thus-formed ink receiving layer, the porous properties desirably satisfy the following conditions to achieve high ink absorbency, satisfactory fixing properties, and the like. The pore volume of the ink receiving layer is preferably 0.1 ml/g or more and 1.0 ml/g or less. In other words, if the pore volume is less than 0.1 ml/g, an ink receiving layer having unsatisfactory ink absorbency is obtained, which may cause overflowing of ink and blurs on images. If the pore volume is more than 1.0 ml/g, cracking and powder falling tend to easily occur on the ink receiving layer. The BET specific surface area of the ink receiving layer is preferably 20 m$^2$/g or more and 450 m$^2$/g or less. If the BET specific surface area is less than 20 m$^2$/g, satisfactory gloss is sometimes not achieved and haze is increased (because of a decrease in transparency), which may cause "white haze" that veils an image. Furthermore, the dye-adsorbing property in ink may be degraded. If the BET specific surface area is more than 450 m$^2$/g, cracking is easily caused on the ink receiving layer.

EXAMPLES

The present invention is further described in detail with Examples and Comparative Examples, but is not limited thereto. Herein, "part" or "%" appearing below is expressed on a mass basis unless otherwise specified. The element contents of the divalent metal and aluminum was measured by inductively coupled plasma optical emission spectrometry (ICP-OES).

Manufacturing of Substrate

A substrate was manufactured as follows. First, a paper stock having the following composition was prepared.

| | |
|---|---|
| pulp slurry (a mixture of 80 parts by mass of laubholz bleached kraft pulp (LBKP) with a freeness of 450 ml Canadian standard freeness (CSF) and 20 parts by mass of nadelholz bleached kraft pulp (NBKP) with a freeness of 480 ml CSF) | 100 parts by mass |
| cationic starch | 0.60 parts by mass |
| heavy calcium carbonate | 10 parts by mass |
| light calcium carbonate | 15 parts by mass |
| alkyl ketene dimer | 0.10 parts by mass |
| cationic polyacrylamide | 0.030 parts by mass |

The paper stock was milled using a Fourdrinier machine, subjected to three-stepped wet pressing, and dried using a multi-cylinder dryer. The paper stock was impregnated with an aqueous oxidized starch solution so as to have a solid content of 1.0 g/m$^2$ using a size press apparatus and then dried. After that, machine calendering was performed on the paper stock to obtain base paper A having a basis weight of 170 g/m$^2$, a Stockigt sizing degree of 100 seconds, an air permeability of 50 seconds, a Bekk smoothness of 30 seconds, and a Gurley stiffness of 11.0 mN.

A resin composition composed of low-density polyethylene (70 parts by mass), high-density polyethylene (20 parts by mass), and titanium oxide (10 parts by mass) was applied to the base paper A in an amount of 25 g/m$^2$. Furthermore, a resin composition composed of low-density polyethylene (50 parts by mass) and high-density polyethylene (50 parts by mass) was applied to the back of the base paper A in an amount of 25 g/m$^2$, whereby a resin-coated substrate was obtained.

Manufacturing of Lower-Layer Coating Solution A

Hydrated alumina (trade name: Disperal HP14 available from Sasol Ltd.) was added to pure water so as to have a content of 23% by mass. Subsequently, acetic acid was added to the resultant solution in an amount of 2.0% by mass relative to the amount of the hydrated alumina under stirring to prepare an alumina sol.

Next, polyvinyl alcohol PVA235 available from KURARAY Co., Ltd. (degree of polymerization: 3500, degree of saponification: 88%) was dissolved in ion-exchanged water to prepare an aqueous PVA solution having a solid content of 8.0% by mass. The prepared PVA solution was added to the alumina sol such that PVA had a solid content of 10% by mass relative to the solid content of the hydrated alumina. Furthermore, 3.0% by mass of boric acid aqueous solution was added to the resultant mixture such that boric acid had a solid content of 1.7% by mass relative to the solid content of the hydrated alumina to manufacture a lower-layer coating solution A.

Manufacturing of Upper-Layer (Uppermost) Coating Solution a

First, 60 g of hydrated alumina (trade name: Disperal HP14 available from Sasol Ltd.) was added to 800 g of pure water, and 1.29 g of magnesium acetate tetrahydrate (element content of Mg/element content of Al=0.006) was added to the resultant mixture. The resultant dispersoid was dried by a spray-drying method to obtain hydrated alumina 1 which magnesium acetate adhered to. The drying temperature (gas phase temperature) was 170° C. The acid site strength of the hydrated alumina 1 was measured by temperature-programmed desorption (TPD) that determines surface activity using ammonia gas. As a result, the presence of acid sites was not confirmed, and it was found that magnesium acetate adhered to hydrated alumina.

An upper-layer coating solution a was then manufactured in the same manner as that of the lower-layer coating solution A, except that the hydrated alumina 1 which magnesium acetate adhered to was used instead of the hydrated alumina of the lower-layer coating solution A.

Manufacturing of Upper-Layer (Uppermost) Coating Solution b

First, 60 g of hydrated alumina (trade name: Disperal HP14 available from Sasol Ltd.) was added to 800 g of pure water, and 2.11 g of calcium acetate monohydrate (element content of Ca/element content of Al=0.012) was added to the resultant mixture. The resultant dispersoid was dried by a spray-drying method to obtain hydrated alumina 2 which calcium acetate adhered to. The drying temperature (gas phase temperature) was 170° C. The acid site strength of the hydrated alumina 2 was measured by temperature-programmed desorption (TPD) that determines surface activity using ammonia gas. As a result, the presence of acid sites was not confirmed, and it was found that calcium acetate adhered to hydrated alumina.

An upper-layer coating solution b was then manufactured in the same manner as that of the lower-layer coating solution A, except that the hydrated alumina 2 which calcium acetate adhered to was used instead of the hydrated alumina of the lower-layer coating solution A.

Manufacturing of Upper-Layer (Uppermost) Coating Solution c

First, 60 g of hydrated alumina (trade name: Disperal HP14 available from Sasol Ltd.) was added to 800 g of pure water, and 2.11 g of calcium acetate monohydrate (element content of Ca/element content of Al=0.012) was added to the resultant mixture. The resultant dispersoid was dried by a spray-drying method to obtain hydrated alumina 2 which calcium acetate adhered to. The drying temperature (gas phase temperature) was 170° C. Subsequently, the hydrated alumina 2 was added to 1 L of pure water, and the resultant mixture was cleaned by a method in which solid-liquid separation is performed on a mixture using a centrifuge to collect a solid. The cleaning was performed three times in total, whereby hydrated alumina 3 which calcium acetate adhered to was obtained. The result of (element content of Ca/element content of Al) of the hydrated alumina 3 measured by ICP-OES was 0.001. The acid site strength of the hydrated alumina 3 was measured by temperature-programmed desorption (TPD) that determines surface activity using ammonia gas. As a result, the presence of acid sites was not confirmed, and it was found that calcium acetate adhered to hydrated alumina.

An upper-layer coating solution c was then manufactured in the same manner as that of the lower-layer coating solution A, except that the hydrated alumina 3 which calcium acetate adhered to was used instead of the hydrated alumina of the lower-layer coating solution A.

Manufacturing of Upper-Layer (Uppermost) Coating Solution d

First, 60 g of hydrated alumina (trade name: Disperal HP14 available from Sasol Ltd.) was added to 800 g of pure water, and 5.28 g of calcium acetate monohydrate (element content of Ca/element content of Al=0.03) was added to the resultant mixture. The resultant dispersoid was dried by a spray-drying method to obtain hydrated alumina 4 which calcium acetate adhered to. The drying temperature (gas phase temperature) was 170° C. The acid site strength of the hydrated alumina 4 was measured by temperature-programmed desorption (TPD) that determines surface activity using ammonia gas. As a result, the presence of acid sites was not confirmed, and it was found that calcium acetate adhered to hydrated alumina.

An upper-layer coating solution d was then manufactured in the same manner as that of the lower-layer coating solution A, except that the hydrated alumina 4 which calcium acetate adhered to was used instead of the hydrated alumina of the lower-layer coating solution A.

Manufacturing of Upper-Layer (Uppermost) Coating Solution e

First, 60 g of hydrated alumina (trade name: Disperal HP14 available from Sasol Ltd.) was added to 800 g of pure water, and 0.106 g of calcium acetate monohydrate (element content of Ca/element content of Al=0.0006) was added to the resultant mixture. The resultant dispersoid was dried by a spray-drying method to obtain hydrated alumina 5 which calcium acetate adhered to. The drying temperature (gas phase temperature) was 170° C. The acid site strength of the hydrated alumina 5 was measured by temperature-programmed desorption (TPD) that determines surface activity using ammonia gas. As a result, the presence of acid sites was not confirmed, and it was found that calcium acetate adhered to hydrated alumina.

An upper-layer coating solution e was then manufactured in the same manner as that of the lower-layer coating solution A, except that the hydrated alumina 5 which calcium acetate adhered to was used instead of the hydrated alumina of the lower-layer coating solution A.

Manufacturing of Upper-Layer (Uppermost) Coating Solution f

First, 60 g of hydrated alumina (trade name: Disperal HP14 available from Sasol Ltd.) was added to 800 g of pure water, and 7.04 g of calcium acetate monohydrate (element content of Ca/element content of Al=0.04) was added to the resultant mixture. The resultant dispersoid was dried by a spray-drying method to obtain hydrated alumina 6 which calcium acetate adhered to. The drying temperature (gas phase temperature) was 170° C. The acid site strength of the hydrated alumina 6 was measured by temperature-programmed desorption (TPD) that determines surface activity using ammonia gas. As a result, the presence of acid sites was not confirmed, and it was found that calcium acetate adhered to hydrated alumina.

An upper-layer coating solution f was then manufactured in the same manner as that of the lower-layer coating solution A, except that the hydrated alumina 6 which calcium acetate adhered to was used instead of the hydrated alumina of the lower-layer coating solution A.

Example 1

The lower-layer coating solution A was applied to the above-described substrate using a slide die coater and then dried to form an ink receiving layer (lower layer) having a dry coated amount of 30 g/m$^2$. Subsequently, pure water was applied to the surface of the lower layer, and the upper-layer coating solution a was applied thereto using a die coater so as to result in a dry coated amount of 8 g/m$^2$. The upper-layer coating solution a was then dried to form an uppermost ink receiving layer (upper layer). Thus, a recording medium of Example 1 of the present invention was manufactured. Furthermore, (element content of divalent metal/element content of aluminum) of the uppermost ink receiving layer was measured by ICP-OES. Table 1 shows the result.

Examples 2 and 3

Recording media of Examples 2 and 3 were manufactured in the same manner as in Example 1, except that the dry coated amounts of the lower-layer coating solution A and the upper-layer coating solution a were changed as shown in Table 1. Furthermore, (element content of divalent metal/element content of aluminum) of the uppermost ink receiving layers was measured by ICP-OES. Table 1 shows the results.

Comparative Examples 1 to 3

Recording media of Comparative Examples 1 to 3 were manufactured in the same manner as in Example 1, except that the dry coated amounts of the lower-layer coating solution A and the upper-layer coating solution a were changed as shown in Table 1. Regarding the recording media of Comparative Examples 1 and 2, (element content of divalent metal/element content of aluminum) of the uppermost ink receiving layers was measured by ICP-OES. Table 1 shows the results.

Example 4

A lower-layer coating solution A and an upper-layer coating solution b were applied to the substrate in that order by simultaneous multilayer coating so as to result in a dry coated amount of 25 g/m$^2$ and a dry coated amount of 5 g/m$^2$, respectively. The two coating solutions were applied using a slide die coater. The two coating solutions were then dried at 40° C. to manufacture a recording medium of Example 4. Furthermore, (element content of divalent metal/element content of aluminum) of the uppermost ink receiving layer was measured by ICP-OES. Table 1 shows the result.

Examples 5 and 6

Recording media of Examples 5 and 6 were manufactured in the same manner as in Example 4, except that the dry coated amounts of the lower-layer coating solution A and the upper-layer coating solution b were changed as shown in Table 1. Furthermore, (element content of divalent metal/element content of aluminum) of the uppermost ink receiving layers was measured by ICP-OES. Table 1 shows the results.

Comparative Examples 4 and 5

Recording media of Comparative Examples 4 and 5 were manufactured in the same manner as in Example 4, except that the dry coated amounts of the lower-layer coating solution A and the upper-layer coating solution b were changed as shown in Table 1. Furthermore, (element content of divalent metal/element content of aluminum) of the uppermost ink receiving layers was measured by ICP-OES. Table 1 shows the results.

Example 7

A lower-layer coating solution A and an upper-layer coating solution c were applied to the substrate in that order by simultaneous multilayer coating so as to result in a dry coated amount of 10 g/m$^2$ and a dry coated amount of 20 g/m$^2$, respectively. The two coating solutions were applied using a slide die coater. The two coating solutions were then dried at 40° C. to manufacture a recording medium of Example 7. Furthermore, (element content of divalent metal/element content of aluminum) of the uppermost ink receiving layer was measured by ICP-OES. Table 1 shows the result.

Example 8

A recording medium of Example 8 was manufactured in the same manner as in Example 7, except that the dry coated amounts of the lower-layer coating solution A and the upper-layer coating solution c were changed as shown in Table 1. Furthermore, (element content of divalent metal/element content of aluminum) of the uppermost ink receiving layer was measured by ICP-OES. Table 1 shows the result.

Example 9

A lower-layer coating solution A and an upper-layer coating solution d were applied to the substrate in that order by simultaneous multilayer coating so as to result in a dry coated amount of 10 g/m$^2$ and a dry coated amount of 20 g/m$^2$, respectively. The two coating solutions were applied using a slide die coater. The two coating solutions were then dried at 40° C. to manufacture a recording medium of Example 9. Furthermore, (element content of divalent metal/element content of aluminum) of the uppermost ink receiving layer was measured by ICP-OES. Table 1 shows the result.

Example 10

A recording medium of Example 10 was manufactured in the same manner as in Example 9, except that the dry coated amounts of the lower-layer coating solution A and the upper-layer coating solution d were changed as shown in Table 1. Furthermore, (element content of divalent metal/element content of aluminum) of the uppermost ink receiving layer was measured by ICP-OES. Table 1 shows the result.

Comparative Example 6

A lower-layer coating solution A and an upper-layer coating solution e were applied to the substrate in that order by simultaneous multilayer coating so as to result in a dry coated amount of 10 g/m$^2$ and a dry coated amount of 20 g/m$^2$, respectively. The two coating solutions were applied using a slide die coater. The two coating solutions were then dried at 40° C. to manufacture a recording medium of Comparative Example 6. Furthermore, (element content of divalent metal/ element content of aluminum) of the uppermost ink receiving layer was measured by ICP-OES. Table 1 shows the result.

Comparative Example 7

A lower-layer coating solution A was applied to the substrate using a slide die coater and then dried to form an ink receiving layer having a dry coated amount of 30 g/m$^2$, whereby a recording medium of Comparative Example 7 was manufactured.

Comparative Example 8

A lower-layer coating solution A and an upper-layer coating solution f were applied to the substrate in that order by simultaneous multilayer coating so as to result in a dry coated amount of 10 g/m$^2$ and a dry coated amount of 20 g/m$^2$, respectively. The two coating solutions were applied using a slide die coater. The two coating solutions were then dried at 40° C. to manufacture a recording medium of Comparative Example 8. Furthermore, (element content of divalent metal/element content of aluminum) of the uppermost ink receiving layer was measured by ICP-OES. Table 1 shows the result.

Comparative Example 9

A Recording medium of Comparative Example 9 was manufactured in the same manner as in Comparative Example 8, except that the dry coated amounts of the lower-layer coating solution A and the upper-layer coating solution f were changed as shown in Table 1. Furthermore, (element content of divalent metal/element content of aluminum) of the uppermost ink receiving layer was measured by ICP-OES. Table 1 shows the result.

Evaluation of Recording Medium

The recording media of Examples 1 to 10 and Comparative Examples 1 to 9 were evaluated in terms of image fastness (gas resistance and light resistance) and optical density of recorded images.

Formation of Printed Image

A monochrome patch of each of black, cyan, magenta, and yellow was printed on each of the uppermost ink receiving layers of the recording media such that the optical density (O. D.) becomes 1.0, to form a recorded image. The printing was performed using an inkjet photo printer (trade name: PIXUS IP8600, ink: BCI-7 available from CANON KABUSHIKI KAISHA).

Image Fastness

Test for Gas Resistance

An ozone exposure test was performed on the recorded image using an ozone weather meter (model: OMS-HS available from Suga Test Instruments Co., Ltd.).

Test Conditions

Exposure gas composition: ozone 3 ppm

Test time: 16 hours

Temperature/humidity conditions in a chamber: 24° C., 60% RH

Evaluation Method of Ozone Resistance

Image densities of the recorded image before and after the test were measured using a spectrophotometer (trade name: Spectrolino available from Gretagmacbeth LLC). The residual rate of image density was calculated from the following formula and the gas resistance was evaluated on the basis of the criteria below.

Residual rate of image density(%)=(image density after test/image density before test)×100

Criteria

Good: Residual rate of image density of cyan is 80% or higher

Fair: Residual rate of image density of cyan is 70% or higher and lower than 80%

Poor: Residual rate of image density of cyan is lower than 70%

Test for Light Resistance

A xenon exposure test was performed on the recorded image using a xenon weather meter (model: XL-750 available from Suga Test Instruments Co., Ltd.).

Test Conditions

Integrated exposure dose: 11000 KLX

Temperature/humidity conditions in a chamber: 23° C., 50% RH

Evaluation Method of Xenon Resistance

Image densities of the recorded image before and after the test were measured using a spectrophotometer (trade name: Spectrolino available from Gretagmacbeth LLC). The residual rate of image density was calculated from the following formula and the light resistance was evaluated on the basis of the criteria below.

Residual rate of image density(%)=(image density after test/image density before test)×100

Criteria

Good: Residual rate of image density of cyan is 90% or higher

Fair: Residual rate of image density of cyan is 80% or higher and lower than 90%

Poor: Residual rate of image density of cyan is lower than 80%

Optical Density (O. D.)

A black solid image (100% duty) was printed on the uppermost ink receiving layer of each of the recording media using an inkjet photo printer (trade name: PIXUS IP8600, ink: BCI-7 available from CANON KABUSHIKI KAISHA). Subsequently, the reflection density of the printed black portion was measured using 310TR (trade name) available from X-Rite Inc.

Criteria

Good: A decrease in reflection density is less than 5% with respect to the reference value of a recording medium Poor: A decrease in reflection density is 5% or higher with respect to the reference value of a recording medium Table 1 shows the evaluation results.

TABLE 1

| | M/AI | Lower layer (g/m$^2$) | Upper layer (g/m$^2$) | Gas resistance | Light resistance | O.D. |
|---|---|---|---|---|---|---|
| Example 1 | 0.006 | 30 | 8 | Fair | Fair | Good |
| Example 2 | 0.006 | 25 | 12 | Good | Good | Good |
| Example 3 | 0.006 | 15 | 20 | Good | Good | Good |
| Example 4 | 0.012 | 25 | 5 | Fair | Fair | Good |
| Example 5 | 0.012 | 17 | 13 | Good | Good | Good |
| Example 6 | 0.012 | 10 | 20 | Good | Good | Good |
| Example 7 | 0.001 | 10 | 20 | Good | Good | Good |
| Example 8 | 0.001 | 25 | 5 | Fair | Fair | Good |
| Example 9 | 0.03 | 10 | 20 | Good | Good | Good |
| Example 10 | 0.03 | 25 | 5 | Good | Good | Good |
| Comparative Example 1 | 0.006 | 32 | 3 | Poor | Poor | Good |
| Comparative Example 2 | 0.006 | 10 | 24 | Good | Good | Poor |
| Comparative Example 3 | — | 35 | 0 | Poor | Poor | — |
| Comparative Example 4 | 0.012 | 27 | 3 | Poor | Poor | Good |
| Comparative Example 5 | 0.012 | 5 | 25 | Good | Good | Poor |

TABLE 1-continued

| | M/AI | Lower layer ($g/m^2$) | Upper layer ($g/m^2$) | Gas resistance | Light resistance | O.D. |
|---|---|---|---|---|---|---|
| Comparative Example 6 | 0.0006 | 10 | 20 | Poor | Poor | Good |
| Comparative Example 7 | — | 30 | 0 | Poor | Poor | — |
| Comparative Example 8 | 0.04 | 10 | 20 | Good | Good | Poor |
| Comparative Example 9 | 0.04 | 25 | 5 | Good | Good | Poor |

As is clear from Table 1, all of the recording media of Examples 1 to 10 had satisfactory gas resistance, light resistance, and optical density (O. D.). In contrast, the recording media of Comparative Examples 1 and 4 had unsatisfactory gas resistance and light resistance because of the small dry coated amounts of the ink receiving layers containing hydrated alumina which a divalent metal compound adheres to. The recording media of Comparative Examples 3 and 7 had unsatisfactory gas resistance and light resistance because the ink receiving layers containing hydrated alumina which a divalent metal compound adheres to were not formed. The recording media of Comparative Examples 2 and 5 had a low optical density of printed images because of the excessively large dry coated amounts of the ink receiving layers containing hydrated alumina which a divalent metal compound adheres to. The recording medium of Comparative Example 6 had unsatisfactory gas resistance and light resistance because the element content of a divalent metal relative to that of aluminum was low in the uppermost ink receiving layers. The recording media of Comparative Examples 8 and 9 had a low optical density of printed images because the element contents of a divalent metal relative to those of aluminum were excessively high.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-115540 filed May 12, 2009, which is hereby incorporated by reference herein in its entirety.

What is claimed is:

1. A recording medium comprising:

a substrate; and at least two ink receiving layers formed on the substrate, wherein an uppermost ink receiving layer of the at least two ink receiving layers has a dry coated amount of 5 $g/m^2$ or more and 20 $g/m^2$ or less and contains hydrated alumina which a divalent metal compound adheres to, and the ratio of an element content of the divalent metal to an element content of aluminum (element content of divalent metal/element content of aluminum) in the uppermost ink receiving layer is 0.001 or more and 0.03 or less.

2. The recording medium according to claim 1, wherein the hydrated alumina which the divalent metal compound adheres to is obtained by drying hydrated alumina in the presence of the divalent metal compound by a spray-drying method.

3. The recording medium according to claim 1, wherein the divalent metal is at least one metal selected from Mg, Ca, Sr, and Ba.

4. The recording medium according to claim 1, wherein the uppermost ink receiving layer has the dry coated amount of 8 $g/m^2$ or more.

5. The recording medium according to claim 1, wherein the ratio of the element content of the divalent metal to the element content of aluminum is 0.005 or more.

6. The recording medium according to claim 1, wherein the ratio of the element content of the divalent metal to the element content of aluminum is 0.02 or less.

7. The recording medium according to claim 1, wherein the divalent metal compound adheres to the surface of the hydrated alumina.

8. The recording medium according to claim 1, wherein the hydrated alumina which the divalent metal compound adheres to does not exhibit an acid function.

9. The recording medium according to claim 1, wherein the hydrated alumina loses acid sites due to the divalent metal compound adhering to the surface of the hydrated alumina.

* * * * *